US008252498B2

(12) United States Patent
Pohlt

(10) Patent No.: US 8,252,498 B2
(45) Date of Patent: Aug. 28, 2012

(54) TONER FOR PRINTING METHOD AND METHOD FOR ELECTROPHORETIC PRINTING PROCESS

(75) Inventor: Michael Pohlt, München (DE)

(73) Assignee: Oce Printing Systems GmbH, Poing (DE)

( * ) Notice: Subject to any disclaimer, the term of this patent is extended or adjusted under 35 U.S.C. 154(b) by 114 days.

(21) Appl. No.: 12/827,273

(22) Filed: Jun. 30, 2010

(65) Prior Publication Data

US 2011/0003245 A1 Jan. 6, 2011

(30) Foreign Application Priority Data

Jul. 1, 2009 (DE) ..... 10 2009 027 386

(51) Int. Cl.
*G03G 9/08* (2006.01)

(52) U.S. Cl. ..... 430/115; 430/116; 430/117.1; 430/32

(58) Field of Classification Search ..... 430/115, 430/116, 117.1, 32
See application file for complete search history.

(56) References Cited

U.S. PATENT DOCUMENTS 3,758,327 A 9/1973 York et al.
3,856,519 A 12/1974 Honjo et al.
2006/0127152 A1 * 6/2006 Nagayama et al. ..... 399/411

FOREIGN PATENT DOCUMENTS

GB 1352067 A 5/1974

* cited by examiner

*Primary Examiner* — Mark A Chapman
(74) *Attorney, Agent, or Firm* — Sutherland Asbill & Brennan LLP

(57) ABSTRACT

Amphiphilic toner which has both hydrophilic groups and lipophilic groups in the molecule, use thereof for an electrophoretic printing process, and method for an electrophoretic printing process using it. The toner is first dispersed in a non-polar carrier liquid, the toner-containing carrier liquid being transported from a charge image carrier by means of a transfer roller to a point of transfer and from there transferred to a substrate. A polar liquid is added before transfer of the toner to the substrate.

21 Claims, 3 Drawing Sheets

TONER FOR PRINTING METHOD AND METHOD FOR ELECTROPHORETIC PRINTING PROCESS

CROSS-REFERENCE TO RELATED APPLICATIONS

This application claims benefit of German Patent Application DE 10 2009 027 386.7, filed Jul. 1, 2009, which is incorporated herein by reference in its entirety.

FIELD OF INVENTION

This invention describes a new toner which can be used for electrophoretic printing methods, as well as a method for an electrophoretic printing process.

BACKGROUND OF THE INVENTION

For printing a recording medium in one or more colours, for example a single sheet or a strip-like recording medium made of different materials, it is known that on a potential image carrier such as a photoconductor, depending on the image, potential images or charge images can be produced, which correspond to the images to be printed, consisting of areas to be inked and areas not to be inked. The areas to be inked, which are also referred to as image areas, of the potential images are made visible by toner with a developer station (inked). Then the toner image is transferred to the recording medium or substrate.

For inking the image areas, either dry toner or a liquid developer which contains the toner dispersed in a liquid can be used here.

A method for electrophoretic liquid development (electrographic development) is already known; see EP 0 756 213 B1 or EP 0 727 720 B1. A non-polar carrier liquid is used as the liquid developer in the prior-art methods, with toner particles present therein in dispersed form. Typical non-polar solutions which are used as the carrier liquid comprise in general silicone oils and hydrocarbons.

An apparatus which contains a developer station consisting of one or more developer rollers for wetting the image carrier element with liquid developer according to the potential images on the image carrier element, is used in the printing process. By means of one or more transfer rollers, the developed potential image is then transferred to the recording medium.

In the known printing processes using a liquid toner, the toner is embedded in a carrier liquid which transports the toner, but without itself contributing to inking. In addition to the above-mentioned silicone oils and hydrocarbons, mineral oils are also used as the carrier liquid. In the usual printing process, the carrier liquid is transferred together with the toner in a printing unit from an inking station to a photoconductor with the latent printed image via a transfer roller onto a substrate or recording medium.

Transfer of the toner to the substrate is ensured by a layer of the carrier liquid between a transfer roller and the substrate. Driven by electrical forces, the toner migrates through the carrier liquid layer from the transfer roller to the substrate. Thus electrophoretic migration of the toner to the substrate takes place.

For effective transfer of the toner, complete wetting of the surface of the substrate by the carrier liquid is necessary, so that the toner can reach the surface of the substrate and does not remain behind on the transfer roller.

With the known method of this kind, however, there is the problem that part of the carrier liquid remains on the substrate after transfer of the toner to the substrate, and the substrate becomes wet. Therefore the substrate with the toner transferred onto it must be dried by evaporation of the carrier liquid. The usual carrier liquids which are indicated above have the drawback, however, that they have high vaporisation points, so that high temperatures are necessary for drying; for example, temperatures of more than approximately 120° C. are usual.

It is known from U.S. Pat. No. 3,856,519 that the carrier liquid can be replaced during the printing process by another one which evaporates at a lower temperature. For this purpose the transfer surface is wetted before actual transfer with a solution consisting of a highly volatile compound. An electrostatic field is applied in order to cause transfer of the toner image to the substrate surface, preventing the high-boiling carrier liquid such as for example the silicone oil from passing to the substrate. However, a method of this kind is very expensive, and wetting of the substrate with the high-boiling carrier liquid is not always completely avoided satisfactorily.

To ensure prevention of explosion, it is necessary to pass large quantities of scavenging air through the heated section and to heat it. This requires a long drying section and increases the energy consumption.

A further drawback of the method described using the carrier liquid for example based on silicone oils lies in that the carrier liquid is lost due to the necessary drying operation and so always has to be topped up again for a further printing process. This is disadvantageous particularly in view of the costs of the printing method.

The problem to be solved by the invention lies in providing a method for an electrophoretic printing process which is cheap and easy to carry out. This invention is intended to provide a toner the use of which in this printing process does not necessitate expensive evaporation of the costly carrier liquid after transfer. Similarly, the carrier liquid is to be reusable for a further printing process.

SUMMARY OF THE INVENTION

According to the invention, the foregoing object is achieved by providing a new toner which is soluble both in non-polar solvents and in polar solvents. The essential characteristic of this invention lies in that at a suitable point during the printing method the toner is transferred from the non-polar carrier liquid to a polar liquid. This is possible because the toner has both hydrophilic groups and lipophilic groups in the molecule and so has amphiphilic properties.

Basically any toner which is traditionally used for such printing processes is suitable as the toner, provided that the toner used according to the invention has both hydrophilic and lipophilic groups. Such groups have long been known from surfactant chemistry, for example, and comprise in particular smaller chemical groups such as —$COO^-$ (carboxylate group), —$SO_3^-$ (sulphonate group), —$OSO_3^-$ (sulphate groups), phosphate groups and/or quaternary ammonium groups, four identical or different radicals being bound to a nitrogen atom. Preferably, carboxylate groups and quaternary ammonium groups are used together in a toner molecule.

Usually known hydrophobic groups are possible as the hydrophobic groups, such as for example hydrocarbon groups, for example alkyl or alkenyl groups which can have a carbon number from approximately 5 to approximately 30.

Particularly preferred toners comprise compositions which contain as the toner resins for example thermoplastic saturated polyester resins, styrene resins such as styrene-acrylic copolymer resins and styrene-acrylic-modified polyester resins, alkyd resins, phenolic resins, epoxy resins, polyamide resins, polyacetol resins, polyethylene resins, polypropylene resins, acrylic resins each on their own or as combinations of two or more of them.

Basically there is no special restriction with regard to the combination of lipophilic groups and hydrophilic groups, provided of course that the desired colouring on the substrate is not adversely affected. The lipophilic molecule groups in the toner are readily dissolved in a non-polar carrier liquid, while the hydrophilic groups are readily dissolved in a polar carrier liquid.

Ordinary carrier liquids can be used as the non-polar carrier liquid, such as the above-mentioned silicone oils, mineral oils or hydrocarbons.

According to the invention, in particular water, pure water or an aqueous-alcoholic solution with a lower alcohol which has for example 2 to 6 carbon atoms can be used as the polar solutions. Preferably, ethanol is used as the alcoholic component. The proportion of water in mixed solutions of this kind can be varied within wide ranges. Preferably the proportion of water is within the range from 10 to 90 wt. %, the remainder being alcohol, particularly preferably 30 to 70 wt. %.

As pigments, for example inorganic pigments such as carbon black, graphite, colcothar, chrome yellow and ultramarine blue or organic pigments such as azo pigments, phthalocyanine pigments, isoindoline pigments, anthrachinone pigments and quinacridone pigments can be used in each case on their own or as combinations of two or more.

It is also possible to use commercially available, quick-drying lacquers and/or brush paints on an aqueous or aqueous-alcoholic basis. Lacquers and/or brush paints of this kind form a coat which dries quickly on the substrate, the toner being transferred to this lacquer or brush paint during transfer.

The non-polar carrier liquid which has the toner particles dispersed therein may contain ordinary further substances such as binders or dyes. Similarly, charge control substances which can take up ions from the toner surface or discharge them to the latter may be contained. Examples include metallic soaps, metal alkoxides and all kinds of surfactants such as anionic, cationic, non-ionic or amphoteric surfactants or combinations of these substances. The quantities used here correspond to the quantities usually used.

For transfer of the toner to the substrate, an electrical field is applied, the toner migrating from the non-polar solvent (carrier liquid) to the polar solvent, so that the substrate substantially or particularly preferably completely comes into contact only with the polar solvent. As a result, it is possible to avoid contact between the non-polar carrier liquid and the substrate.

To optimise the efficiency of transfer between the non-polar and the polar solvent, an electrical field is available. In the polar solvent usually the conductivity is too high to build up an electrical field over it, so that the field lies almost completely in the non-polar solvent. The toner is therefore drawn towards the boundary surface. The remainder is caused by the polar ends at the toner, which anchor the toner in the polar solvent and ultimately cause transfer. For this it is helpful if the toner shows better solubility in the polar solvent than in the non-polar one. A limiting factor for this adjustment is only the requirement that the toner still remains sufficiently soluble in the non-polar solvent in order not to settle quickly; otherwise it would not be easy to transport and store.

Toner which is not transferred at the transition from non-polar to polar solvent can be returned and reintroduced into the printing process.

After transfer of the toner, fixing and drying take place in the usual manner, air drying being particularly preferred.

It is evident that the toner used according to the invention is, owing to its amphiphilic properties, transferred during the printing process from the non-polar carrier liquid to a polar solution, so that only the polar solution comes into contact with the substrate to be printed. As a result, the previously known and necessary expensive operation of drying the polar carrier liquid which has a high boiling point is avoided, and therefore the method according to the invention is cheaper and easier to carry out.

According to the invention there are several possibilities for when the polar solution is introduced into the printing process.

One possibility consists of conveying a charge image carrier with the non-polar carrier liquid containing the toner in dispersed form to a transfer roller. At the transition from the charge image carrier to the transfer roller, the polar solution can be delivered by a further delivery roller, so that at the transition point between charge image carrier and transfer roller the toner-containing carrier liquid comes into contact with the polar solution. Due to its amphiphilic properties, the toner migrates from the carrier liquid into the polar solution and is further carried on the transfer roller to the point of transfer, and passes from the latter onto the substrate to be printed, which is guided between the transfer roller and a counterpressure roller arranged opposite the latter. As a result the polar solution passes together with the toner particles onto the substrate. In the process, the polar solution forms as even and complete a film as possible on the substrate, the thickness of the closed film being approximately 2 to 20 μm, preferably 5 to 20 μm, further preferably approximately 7 to 10 μm.

Transfer to the substrate usually takes place at temperatures between 18 and 30° C., room temperature (20 to 22° C.) being particularly preferred.

The non-polar carrier liquid in this practical example remains only on the charge image carrier and can if occasion arises after cleaning be returned to a further printing process again. The cleaning device is in this case arranged behind the transition point between charge image carrier and transfer roller.

Due to this procedure, it is in particular possible to avoid the loss of non-polar carrier liquid, or reduce it to a minimum. Furthermore, with the method according to the invention it is no longer necessary to use high drying temperatures, because the non-polar carrier liquid with its high boiling point no longer passes onto the substrate. Instead, on the substrate there is a relatively readily evaporating liquid such as water or an aqueous-alcoholic solution, or a quick-drying lacquer or brush paint, with the result that the subsequent drying operation can be performed easily and efficiently in an economical manner. Hence the method is distinguished by a lower energy consumption, and furthermore there are also advantages because hazardous solutions do not have to be removed from the printed substrate.

According to an alternative embodiment it is also possible to transport the carrier liquid, which has the toner dispersed in it and contains the non-polar solvent, via the charge image carrier and the transfer roller to the point of transfer. From a roller which is provided in addition, the polar liquid described above is applied directly to the substrate, and the substrate wetted in this way is guided to the point of transfer. On contact of the substrate wetted in this way with the transfer roller and the counterpressure roller arranged opposite, at this point transfer of the toner from the non-polar solution to the polar solution takes place. In this variant too, it is ensured that the non-polar solution does not wet the substrate, so that only the polar solution is present on the substrate. Here too, subsequent drying can be carried out in a simple manner as described above. The transfer roller after contact with the substrate contains only the non-polar carrier liquid, which can then if occasion arises be cleaned by an additionally provided cleaning device and returned for a further printing process.

Thus it is possible due to the method according to the invention to return carrier liquid for further printing processes. Furthermore, easy drying of the substrate provided with the toner image is possible, because on this substrate are highly volatile substances which furthermore have no hazard potential.

BRIEF DESCRIPTION OF THE DRAWINGS

This invention is described in more detail with reference to the drawings, in which.

DETAILED DESCRIPTION

Figure 1:
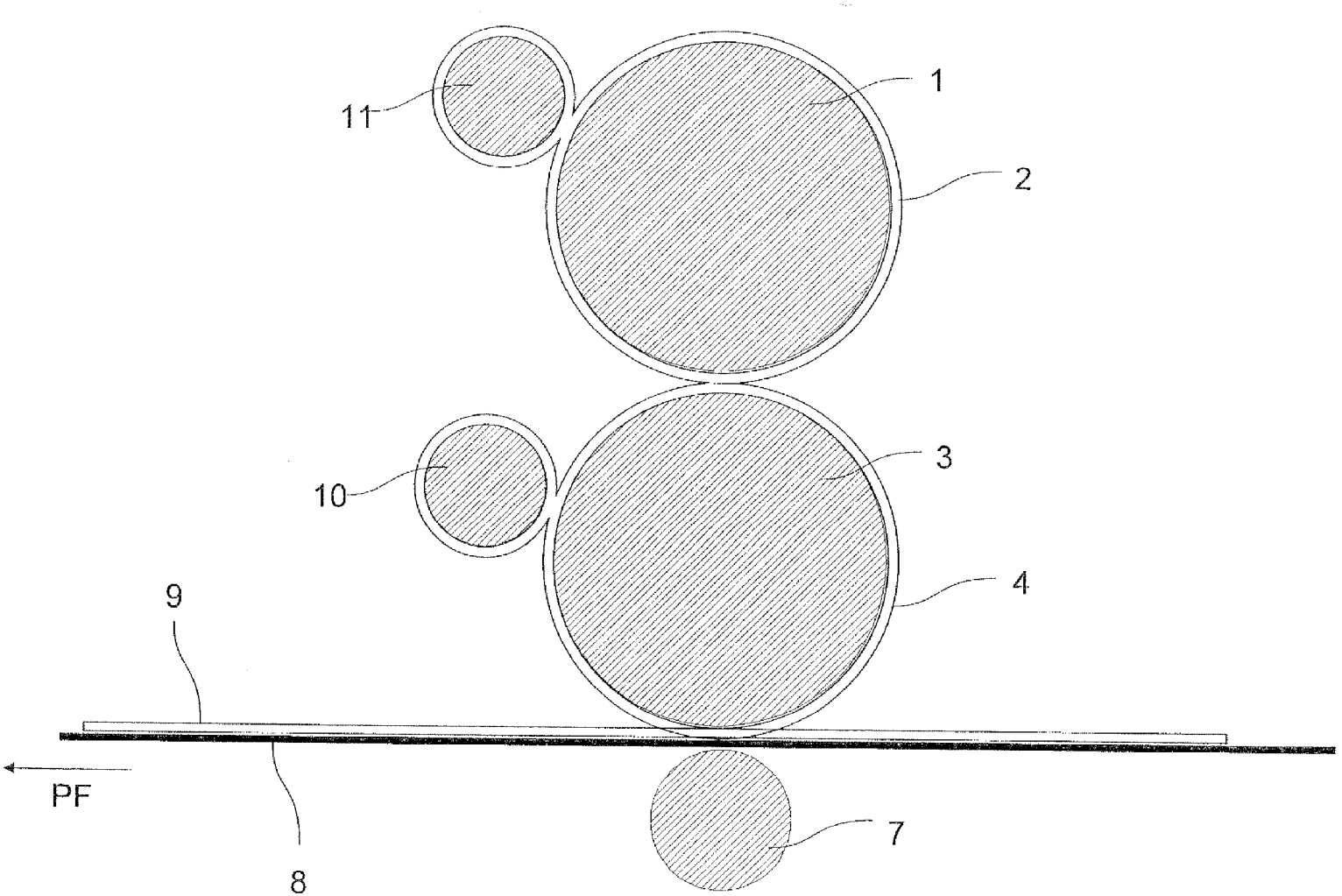
FIG. 1 shows schematically the printing process according to a first embodiment of this invention.

As shown in FIG. 1, non-polar carrier liquid is transferred together with the amphiphilic toner according to this invention by an applicator roller (11) to a charge image carrier (1). On the charge image carrier (1), the carrier liquid with toner dispersed therein and other components such as binder and additional pigment particles forms a uniform thin-film. The charge image carrier (1) is moved anticlockwise and comes into contact with a transfer roller (3). This transfer roller (3) is provided with a delivery roller (10) for delivering a polar liquid such as for example water or the other above-mentioned solutions. A thin film of the polar liquid is formed on the surface of the transfer roller by this delivery roller (10). Upon contact between the transfer roller (3) and the charge image carrier (1), the polar and non-polar solutions encounter each other, the amphiphilic toner due to its properties of dissolving in the polar solvent becoming dissolved therein and migrating into the polar solution. Hence after contact with the charge image carrier, on the transfer roller which is also moved clockwise is found only the polar solution together with the toner and other components as mentioned above, if any, but no longer the non-polar carrier liquid. The non-polar carrier liquid remains instead on the charge image carrier and may if occasion arises after passing through a cleaning device, not shown in the figures, be cleaned and returned to the roller (11).

The toner particles together with the polar solution are carried further by means of the transfer roller to the so-called transfer station for transfer to the substrate (8). The substrate (8) is passed through between the transfer roller (3) and a counterpressure roller (7) arranged opposite. On contact with the transfer roller (3), wetting of the substrate (8) with the polar carrier liquid and the toner to the substrate is carried out, producing the printed image (9). Then ordinary drying and fixing take place, air drying being carried out preferably.

Alternatively it is also possible to heat the transfer roller (3) and/or the counterpressure roller (7), so that transfer of the toner image and evaporation of the polar solution can take place simultaneously (transfusing).

Figure 2:
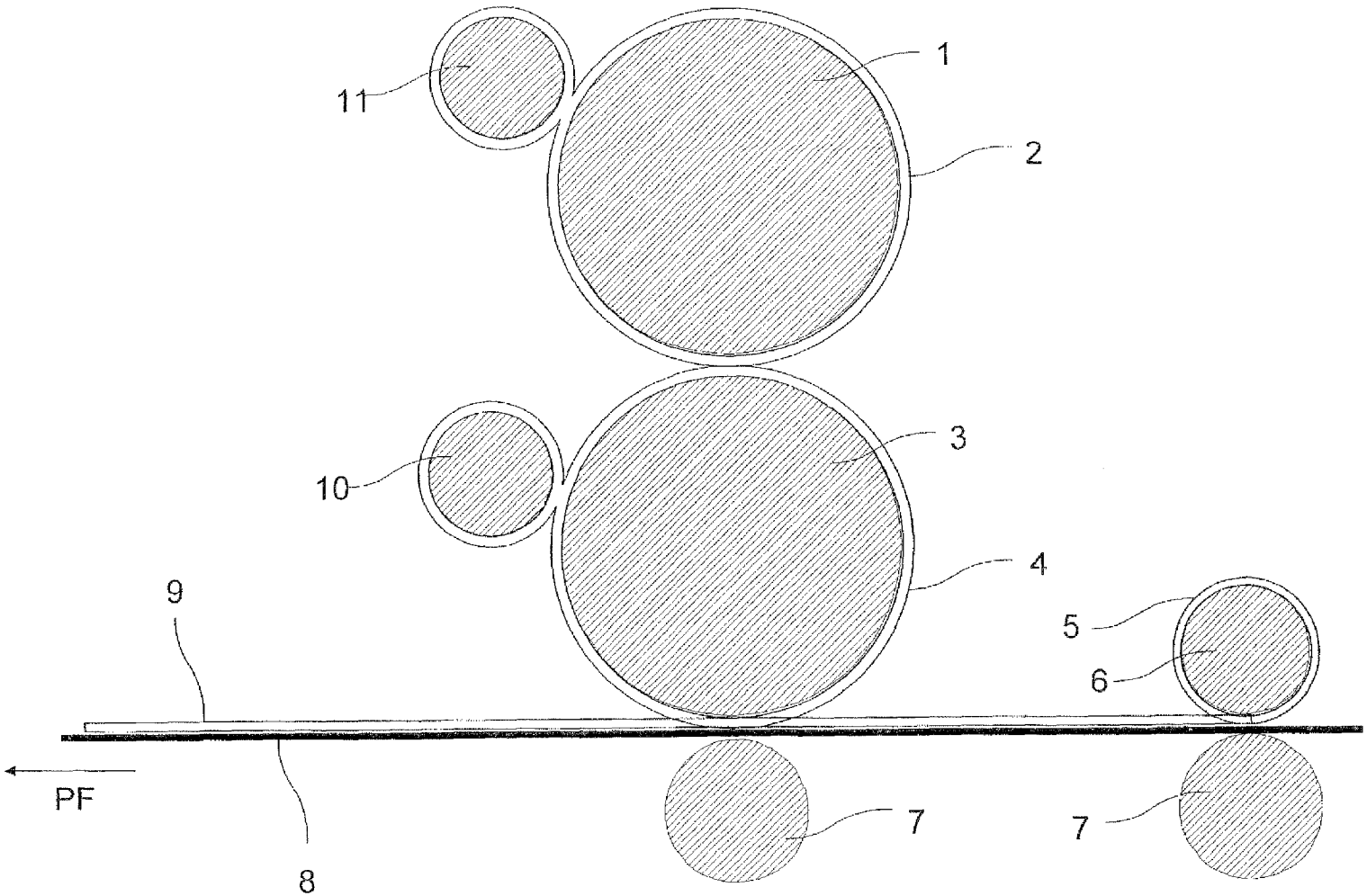
FIG. 2 shows schematically the printing process according to a second embodiment of this invention.

FIG. 2 shows a further embodiment according to the method of the invention, which is preferred over the first embodiment described above.

In this alternative the non-polar carrier liquid, is transferred together with the toner from the charge image carrier (1) and, if occasion arises, other components to the transfer roller (3). The substrate (8) is, as in the first embodiment, guided through between the transfer roller (3) and a counterpressure roller (7) arranged opposite, the point of transfer being located at the point of contact. Before reaching this point of transfer, a polar solution is applied directly to the substrate by means of an additional roller (6) and a further counterpressure roller (7') arranged opposite the latter. At this point a uniform and closed film of the polar solvent or the aforementioned lacquer and/or brush paint is formed. The substrate wetted in this way then passes to the point of transfer between the transfer roller (3) and the counterpressure roller (7), and contacts the non-polar carrier liquid which has the toner particles in it. Due to the amphiphilic properties of the toner, in this variant too, transfer of the toner from the non-polar carrier liquid to the polar solvent takes place, so that in this variant too, only the polar solution together with the toner comes into contact with the substrate (8). The no longer needed non-polar carrier liquid on the transfer roller (3) is delivered to a cleaning device (not shown) and can, as in the first embodiment, be returned for a further printing process.

With the method according to the invention, any material that is usually used can be employed as the substrate. For instance, paper or thin plastic films or metal foils are used as substrates. Normal paper or surface-treated paper can be used as the paper. A surface coating is also possible with the thin plastic films or metal foils. It is also possible to carry out primer coating with the substrate used, before printing, for example to prevent penetration of the aqueous or aqueous-alcoholic solution into the paper and so further accelerate the subsequent drying operation.

The method according to the invention has special advantages particularly with respect to being cheap to carry out, and avoiding unnecessarily high temperatures during the drying operation. By using an amphiphilic toner it is possible to cause transfer from the non-polar solution to the polar solution easily, so that almost exclusively the polar solution comes into contact with the substrate surface. As a result the non-polar carrier liquid can easily be returned and reused for a further printing process.

Figure 3:
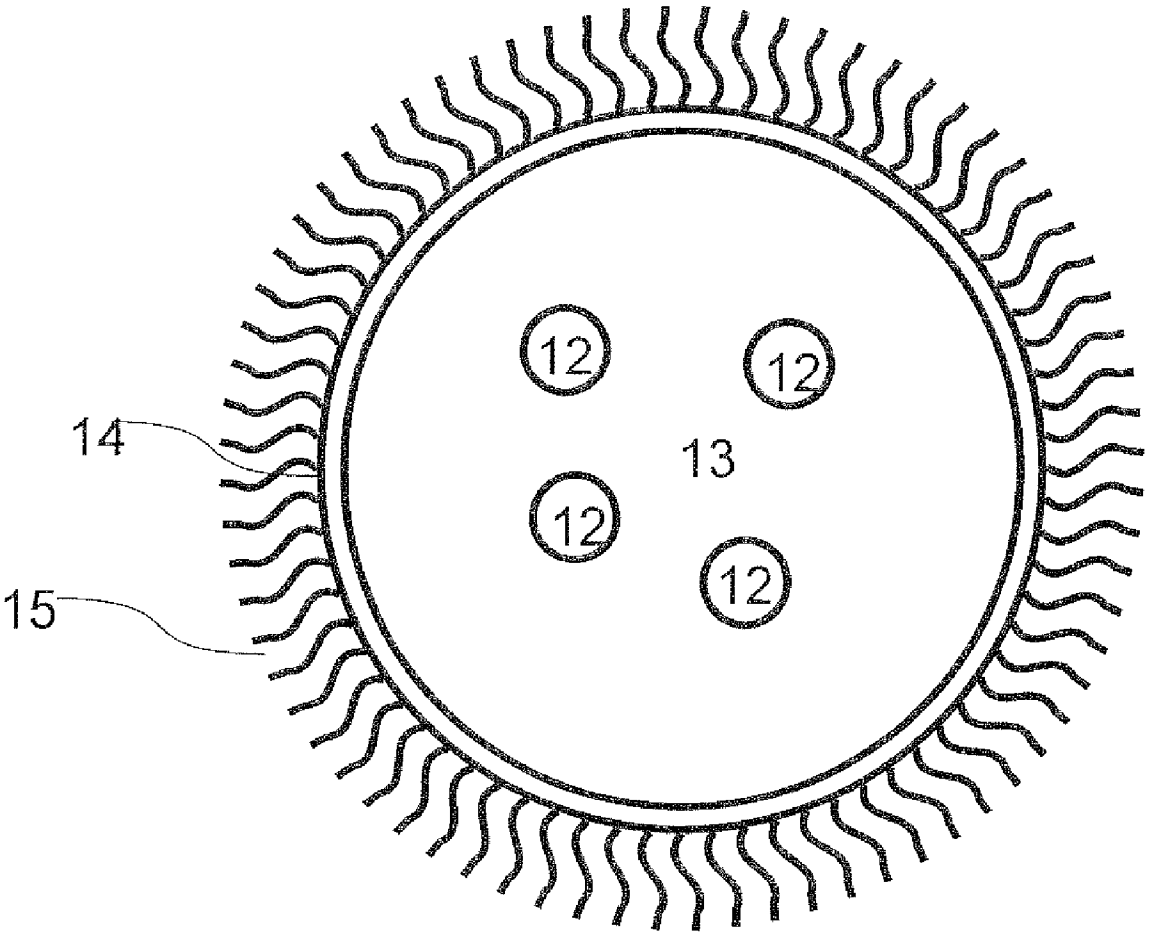
FIG. 3 shows schematically a toner particle according to this invention.

FIG. 3 shows a preferred toner particle according to this invention. Pigments (12) are dispersed in a binder (13). Ordinary pigments which are used to provide the colour in the printing process indicated are used as the pigments. The usual requirements of such pigments are in particular provision of the desired shade of colour, and furthermore the pigments are to have light-fastness but also thermal stability. Similarly, a good dispersability of the pigments in the binder is desired. If occasion arises, the pigments can contain a coating on the surface for improving the dispersability and as an adhesion-promoting agent between pigment and binder. A preferred coating is colourless and produced from a thermoplastic material.

The thickness of such a coating, if any, is in the region of nanometres and is preferably 5 to 100 nm, particularly preferably 5 to 50 nm, particularly preferably 5 to 30 nm.

The binder (13) serves as a dispersion medium for the pigment (12) and to cause adhesion to the substrate. Usually a binder resin such as a thermoplastic material is used as the binder. Preferably the binder is colourless, so that the colouring is not impaired by the pigments used. Furthermore, after fixing to the substrate it is to be abrasion-resistant.

The surface of the binder (13) preferably contains a coating (14) which is formed from an additive for steric stabilisation. The purpose of this layer (14) is to improve the dispersion of the toner particles in the carrier liquid used. The additive for steric stabilisation is contained in a charge layer (15) which contains functional groups for charge generation and for avoiding agglomeration. The material of the charge layer is as a rule insoluble in the carrier liquid. Preferred functional groups are basic groups.

The additive for steric stabilisation forms a unit with the charge layer (15). The molecules contained are essentially bound to the binder (13) by chemisorption, to avoid unwanted desorption and hence destabilisation of the dispersion. The charge layer (15) and the additive for steric stabilisation (14) do not have to form a closed surface on the toner particle. It is also possible for, for example, only 30 up to a maximum of 50% of the particle surface to be covered with this layer. The total thickness of the layer consisting of the charge layer (15) and the additive for steric stabilisation (14) comprises several nanometres, preferably 5 to 20 nm, particularly preferably 8 to 15 nm.

Preferably the pigment content of the toner particle is 1 to 25 wt. %, preferably 1 to 20 wt. %, the concentration of the toner particle in the liquid developer as a rule being approximately 25 to 45 wt. %, preferably 30 to 40 wt. %. The particle size of the toner particle including the charge layer (15) is preferably 0.8 to 1.5 μm, particularly preferably approximately 1 μm.

I claim:

1. A toner for an electrophoretic printing method, comprising:

a toner composition which comprises molecules having both hydrophilic groups and lipophilic groups, wherein the toner composition is in the form of particles having a size from 0.8 to 1.5 microns.

2. The toner of claim 1, wherein the hydrophilic groups comprise carboxylate, sulphonate, sulphate or quaternary ammonium groups on their own or in combination with each other, and the lipophilic groups comprise hydrocarbon groups.

3. The toner of claim 1, wherein the particles comprise a pigment dispersed in a binder.

4. The toner of claim 3, wherein at least part of the surfaces of the particles comprises a coating which includes an additive for steric stabilisation and a charge layer.

5. A method for electrophoretic printing, comprising:

transporting a toner-containing carrier liquid from a charge image carrier by means of a transfer roller to a point of transfer and from the point of transfer to a substrate, the toner-containing carrier liquid comprising a toner dispersed in a non-polar carrier liquid; and adding a polar liquid to the toner before transfer of the toner to the substrate, the toner being soluble in the polar liquid, wherein the toner comprises molecules having both hydrophilic groups and lipophilic groups.

6. The method of claim 5, wherein the polar liquid is conducted to the transfer roller.

7. The method of claim 5, wherein the polar liquid forms a uniform film on the substrate with a thickness of 2 to 20 μm.

8. The method of claim 5, wherein the polar liquid is water, an aqueous-alcoholic solution or a lacquer or brush paint on an aqueous basis or a combination thereof.

9. The method of claim 5, further comprising, after transfer of the toner to the substrate, cleaning the non-polar carrier liquid and returning the non-polar carrier liquid to a delivery roller for a further printing process.

10. The method of claim 5, further comprising fixing a toner image produced by the transfer of the toner to the substrate.

11. The method of claim 5, wherein the toner contains carboxylate, sulphonate, sulphate or quaternary ammonium groups on their own or in combination with each other as the hydrophilic groups and hydrocarbon groups as the lipophilic groups.

12. The method of claim 5, wherein the toner is in the form of particles having a size from 0.8 to 1.5 microns.

13. A method for electrophoretic printing, comprising:

transporting a toner-containing carrier liquid from a charge image carrier by means of a transfer roller to a point of transfer and from the point of transfer to a substrate, the toner-containing carrier liquid comprising a toner dispersed in a non-polar carrier liquid; and applying a polar liquid to the substrate before transfer of the toner to the substrate at the point of transfer, the toner being soluble in the polar liquid, wherein the toner comprises molecules having both hydrophilic groups and lipophilic groups.

14. The method of claim 13, wherein the polar liquid is applied to the substrate by an additional roller and comes into contact with the toner-containing non-polar carrier liquid at the point of transfer.

15. The method of claim 14, further comprising conducting the polar liquid to the transfer roller by a delivery roller.

16. The method of claim 13, wherein the polar liquid forms a uniform film on the substrate with a thickness of 2 to 20 μm.

17. The method of claim 13, wherein the polar liquid is water, an aqueous-alcoholic solution or a lacquer or brush paint on an aqueous basis or a combination thereof.

18. The method of claim 13, further comprising, after transfer of the toner to the substrate, cleaning the non-polar carrier liquid and returning the non-polar carrier liquid to a delivery roller for a further printing process.

19. The method of claim 13, further comprising fixing a toner image produced by the transfer of the toner to the substrate.

20. The method of claim 13, wherein the toner contains carboxylate, sulphonate, sulphate or quaternary ammonium groups on their own or in combination with each other as the hydrophilic groups and hydrocarbon groups as the lipophilic groups.

21. The method of claim 13, wherein the toner is in the form of particles having a size from 0.8 to 1.5 microns.

* * * * *